US008678761B2

(12) United States Patent
Toseland

(10) Patent No.: US 8,678,761 B2
(45) Date of Patent: Mar. 25, 2014

(54) PUMP DEVICE

(75) Inventor: John Toseland, Glasgow (GB)

(73) Assignee: Clyde Union Limited, East Kibride (GB)

( * ) Notice: Subject to any disclaimer, the term of this patent is extended or adjusted under 35 U.S.C. 154(b) by 511 days.

(21) Appl. No.: 13/096,684

(22) Filed: Apr. 28, 2011

(65) Prior Publication Data

US 2012/0107113 A1 May 3, 2012

(30) Foreign Application Priority Data

Apr. 30, 2010 (GB) ..... 1007241.1

(51) Int. Cl.
*F04D 29/42* (2006.01)

(52) U.S. Cl.
USPC ..... 415/214.1; 415/206; 415/229; 415/104

(58) Field of Classification Search
USPC ..... 415/104, 206, 214.1, 229
See application file for complete search history.

(56) References Cited

U.S. PATENT DOCUMENTS

| | | | | |
|---|---|---|---|---|
| 1,639,494 | A | 8/1927 | Flanders | |
| 1,967,316 | A * | 7/1934 | Meeker | 415/106 |
| 3,274,897 | A * | 9/1966 | Reinke | 91/507 |
| 5,613,831 | A | 3/1997 | Liegat | |
| 6,929,449 | B2 * | 8/2005 | Zagone et al. | 415/206 |

FOREIGN PATENT DOCUMENTS

| | | |
|---|---|---|
| GB | 726436 | 3/1955 |
| GB | 1152139 | 5/1969 |

OTHER PUBLICATIONS

UK Search Report for GB1007241.1, Dated Jun. 30, 2010.

* cited by examiner

*Primary Examiner* — Ninh H Nguyen
(74) *Attorney, Agent, or Firm* — Baker & Hostetler LLP

(57) ABSTRACT

A pump device for applying a force opposing axial movement of a pump rotor shaft relative to a pump housing, the pump device having a first housing part, a second housing part axially moveable relative to the first housing part, and a biasing member coupled between the first housing part and the second housing part.

11 Claims, 4 Drawing Sheets

PUMP DEVICE

FIELD OF THE INVENTION

This invention relates to a pump device. In particular, but not exclusively, this invention relates to a pump lift-off device for opposing an axial thrust force generated by a pump rotor shaft during operation. The invention also relates to a pump system comprising the pump device.

BACKGROUND TO THE INVENTION

Rotary pumps, such as boiler feed pumps, typically develop an axial thrust force during operation, this force resulting from the differential pressures acting across the, or each, impeller mounted on the pump rotor shaft. The pump may include a thrust bearing which supports some degree of movement of the rotor shaft. However, with high pressure pumps and/or where multiple impeller stages are provided, the axial thrust force can be significant so that some additional means of opposing the force is generally required in order to prevent axial movement of the pump rotor shaft and the resulting damage to the pump and/or pump components.

One way of countering axial movement of the shaft is to provide a balance disk assembly having a balance disk formed or mounted on the pump shaft and a stationary counter disk formed or mounted on the pump housing, the balance disk and counter disk being offset from each other. The balance disk is positioned at the high pressure/downstream end of the pump so that one side of the balance disk is exposed to the full discharge pressure of the pump. The other side of the balance disk is in fluid communication with the pump suction/inlet which is at lower pressure. Accordingly, the balance disk experiences a force equal to the product of the pressure differential across the balance disk multiplied by the exposed disk area, this force opposing the axial thrust force generated by the pump rotor shaft.

During normal operation, the pressure differential is high so that the balance disk assembly generates a force sufficient to substantially balance the axial thrust force generated by rotation of the pump rotor shaft. However, the pressure differential acting across the balance disk varies during the operational cycles of the pump. For example, where the pump rotor shaft is rotating at relatively low speed and, in particular during start-up or shut-down procedures, the opposing force may not be sufficient to balance the axial thrust force generated by the pump rotor shaft. Where this occurs, the balance disk may contact the stationary counter disk resulting in wear of the disk and can ultimately lead to significant damage to the pump and pump components, such as the pump thrust bearing for example.

Where a pump fitted with a balance disk assembly is expected to be subject to a high number of start-stop cycles, for example more than two start-stop cycles per day, it is generally recommended that a lift-off device be provided. The function of the lift-off device, as the name suggests, is to apply an axial force to the pump rotor shaft which acts to separate, or lift, the balance disk away from the counter disk and to prevent damaging contact where the opposing force generated by the balance disk assembly alone is insufficient to oppose the axial thrust force generated by the pump rotor shaft.

Even where a balance disk assembly and a lift-off device are provided, some issues remain. For example, the balance disk assembly is typically located within the pump housing and is relatively inaccessible. One result of this is that it is difficult for the pump operator to ascertain the condition of the balance disk assembly without shutting down the pump and taking the pump apart. In some cases, failure of the balance disk assembly is not identified until damage to the pump or pump components has already occurred. Also, the balance disk assembly and lift-off device represent additional components which must be taken into consideration when assessing reliability and cost effectiveness of the pump system during design, manufacture, operation, and maintenance.

SUMMARY OF THE INVENTION

According to a first aspect of the present invention there is provided a pump device for applying a force opposing axial movement of a pump rotor shaft relative to a pump housing, the device comprising: a first housing part formed on or adapted to be coupled to a pump housing and a second housing part axially moveable relative to the first housing part, the second housing part formed on or adapted to be coupled to the pump rotor shaft; a biasing member coupled between the first housing part and the second housing part and configured to apply a force opposing axial movement of the pump rotor shaft in the pump housing, wherein the spacing between the first housing part and the second housing part is configured to indicate the axial position of the pump rotor shaft within the pump housing.

A device according to embodiments of the present invention provides a force opposing axial movement of the pump rotor shaft, in particular movement resulting from the axial force generated by rotation of the pump rotor shaft. Embodiments of the invention oppose the axial movement and axial thrust force even where the pump rotor shaft is rotating at relatively low rotational speeds such as during start-up or shut-down of the pump, thereby protecting the pump and/or pump components from damage. Embodiments of the invention also permit the axial position of the pump rotor shaft relative to the pump housing to be readily identified, for example via a visual check by an operator, before damage to the pump and/or pump components has occurred and without the requirement to shut down and disassemble the pump. Moreover, where the pump is fitted with a balance disk assembly having a balance disk on the pump shaft and a counter disk on the pump housing, embodiments of the invention act to separate the balance disk and counter disk to prevent, or at least mitigate, damaging contact and/or wear between the balance disk and the counter disk. The device is also configured to provide an indication of the spacing between the balance disk and the counter disk, whereby it can readily be determined whether the balance disk assembly has become worn or is configured correctly.

In particular embodiments, the pump device comprises a pre-assembled cartridge adapted to be mounted to the pump. The use of a cartridge beneficially permits the pump device to be easily and quickly attached and detached from the pump, for example where it is necessary to gain access to the pump, pump components or to replace and/or repair the pump device itself. Where the pump device is to be replaced, a replacement cartridge can be attached to the pump so that operation of the pump can be resumed, thereby greatly reducing the non-operational time or mean time to repair (MTTR) for the pump system. It will be recognised that pumps are often used in critical infrastructure such as power generation, water infrastructure, and petrochemical facilities for example, whereby reduction of down time and maintaining safe and efficient operation of the pump system represent significant benefits. Alternatively, the first and second housing parts may be formed on the pump housing and pump rotor shaft.

The device may further comprise a shaft (referred to hereinafter as the device shaft) and the device shaft may be adapted to be coupled to the pump rotor shaft. In particular embodiments, the device shaft is rotatably coupled to the second housing part. In use, the opposing force may be transmitted to the pump rotor shaft via the device shaft. Furthermore, where movement of the pump rotor shaft does occur, for example where the balance disk assembly has become worn, axial movement of the pump rotor shaft may also act to move the device shaft and the second housing part relative to the first housing part, thereby indicating that a repair should be effected.

The device shaft may be rotatably supported by any suitable means. The device shaft may be rotatably coupled to the second housing part by at least one bearing and in particular embodiments a plurality of bearings may be provided. The, or each, bearing may comprise at least one of a ball bearing, an angular contact bearing, a journal bearing or the like. In particular embodiments, a first end of the device shaft may be supported by a ball bearing and a second end of the device shaft may be supported on an angular contact bearing, the angular contact bearing facilitating transfer of the opposing force to the pump rotor shaft via the device shaft.

The biasing member may comprise any suitable means for generating the opposing force on the pump rotor shaft and, in use, the member biases the first housing part and the second housing apart to oppose the axial thrust force. For example, the biasing member may comprise a spring, such as a coil spring, secured between the first housing part and the second housing part. In particular embodiments, a plurality of springs may be provided. Alternatively, or in addition, the biasing member may comprise one or more of a fluid piston arrangement, elastic element and electromagnetic element. Alternatively, or in addition, the first housing part and the second housing part may be configured to provide the force opposing axial movement of a pump rotor shaft relative to a pump housing and so form the biasing member.

The device may further comprise a guard which provides an enclosure to protect the device from damage and/or protect the operator from injury.

According to a second aspect of the present invention, there is provided a pump system comprising: a pump; and a pump device according to the first aspect of the invention.

According to a third aspect of the present invention, there is provided a pump device comprising: a first housing part adapted to be coupled to a pump housing and a second housing part axially moveable relative to the first housing part, the second housing part adapted to be coupled to the pump rotor shaft, wherein the spacing between the first housing part and the second housing part is configured to indicate the axial position of the pump rotor shaft within the pump housing.

Accordingly, embodiments of the present invention may also relate to a retrofit device which may be coupled to an existing pump and/or an existing pump lift-off device and configured to indicate the axial position of the pump rotor shaft within the pump housing

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
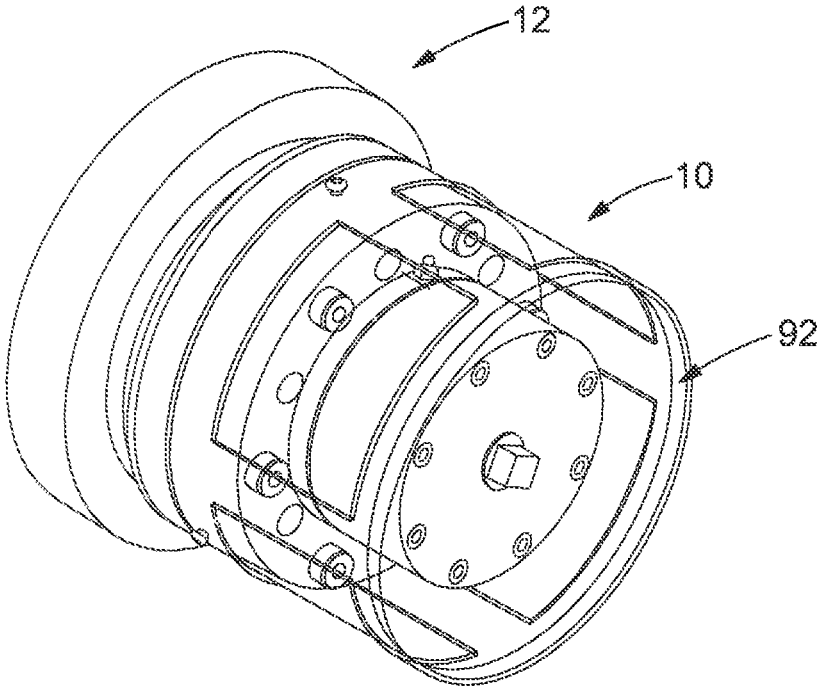
FIG. 1 is a perspective view of a pump device according to an embodiment of the present invention.
Figure 2:
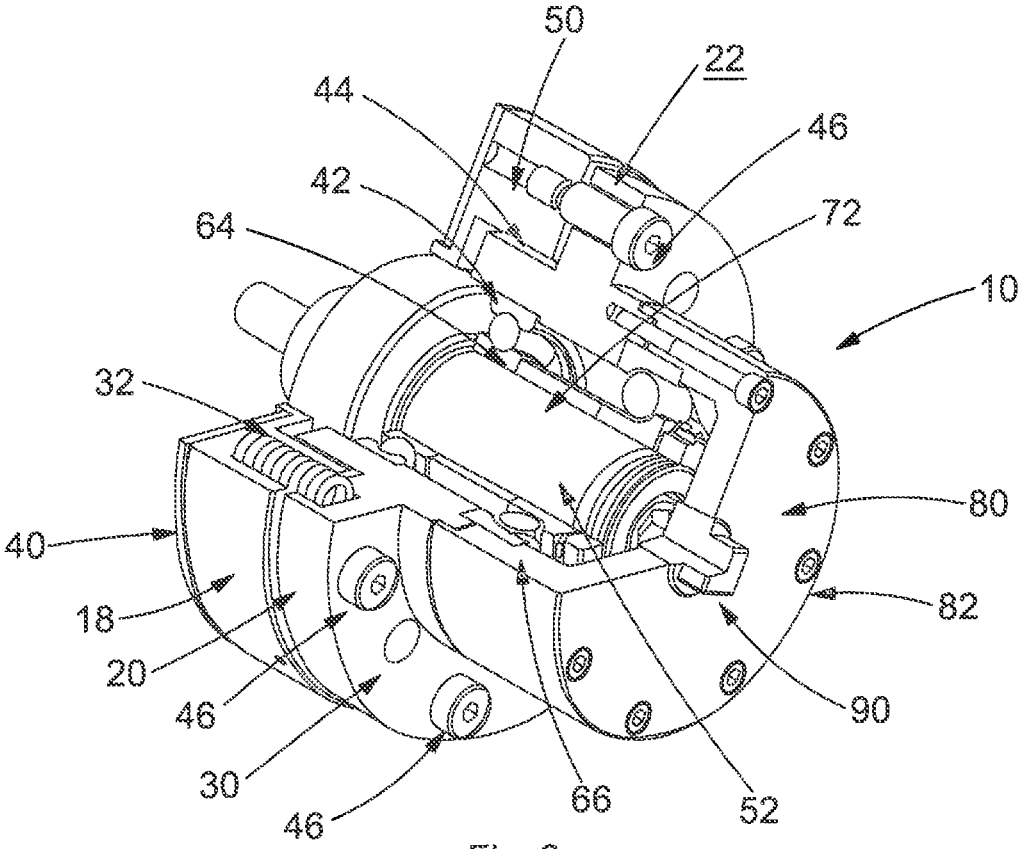
FIG. 2 is a cut-away view of part of the pump device of FIG. 1 with guard removed.
Figure 3:
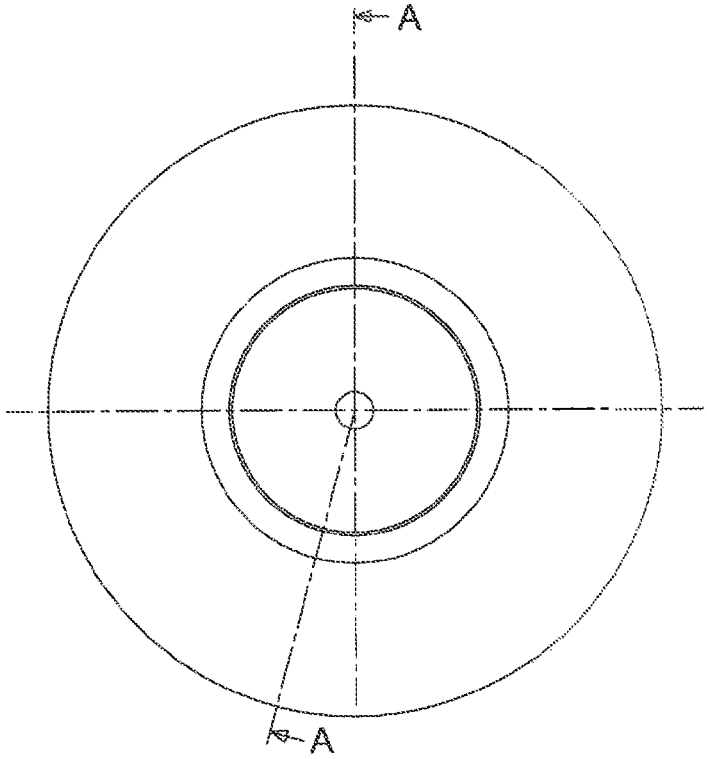
FIG. 3 is a schematic view showing the position of longitudinal section A-A.
Figure 4:
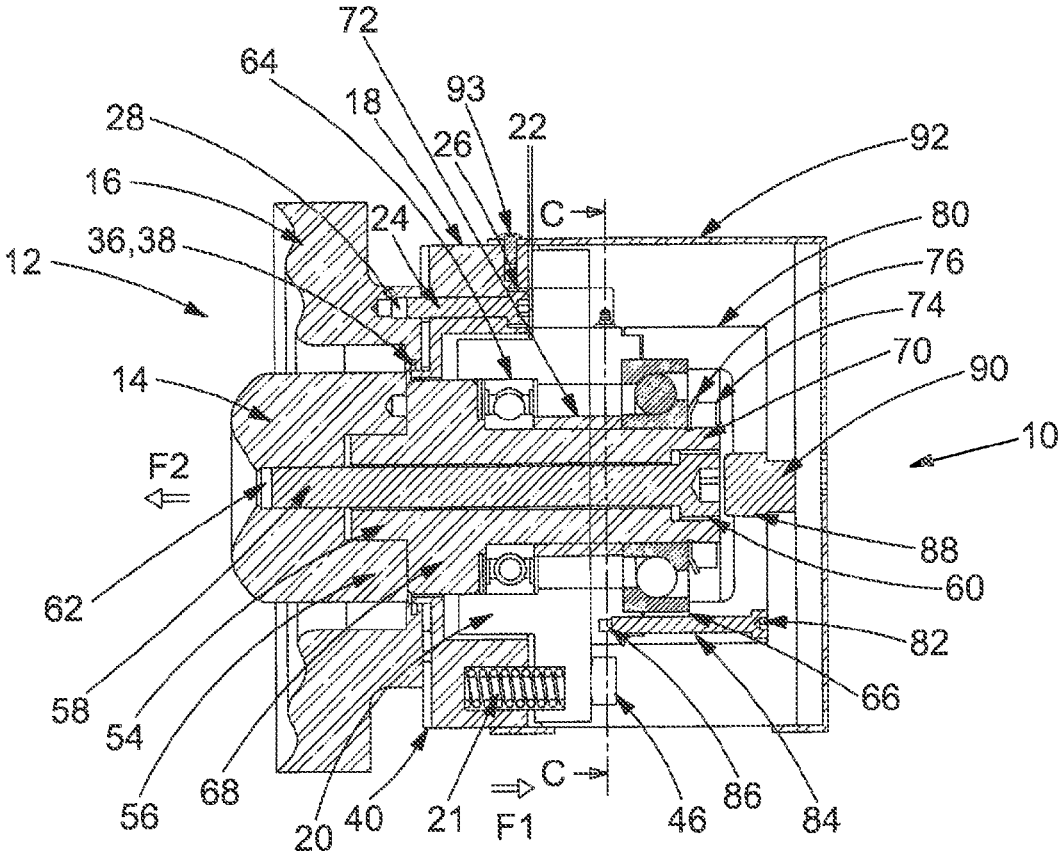
FIG. 4 is a longitudinal sectional view of section A-A of FIG. 3.
Figure 5:
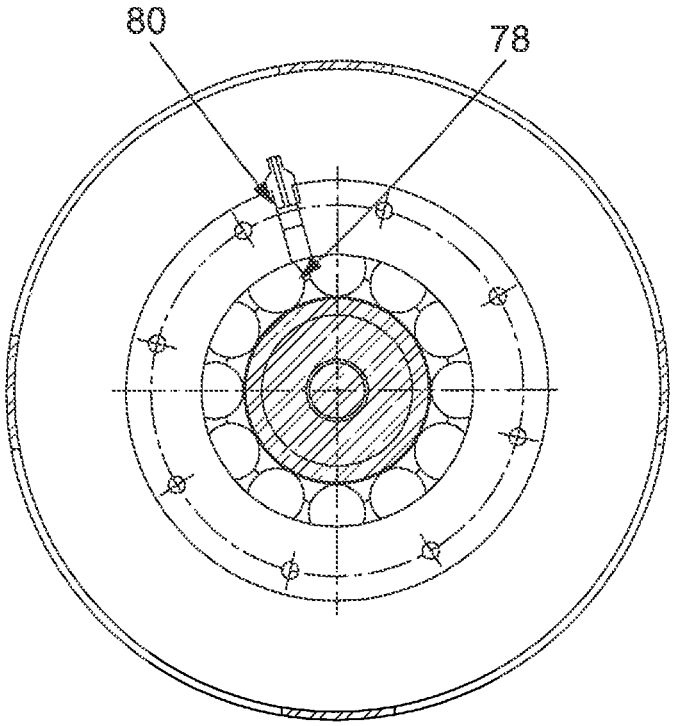
FIG. 5 is a cross sectional view of section C-C of FIG. 4.

Referring initially to FIGS. 1 to 4 of the drawings, there is shown a pump lift-off device 10 according to an embodiment of the present invention. The device 10 is adapted for coupling to a pump 12 and, in use, provides an axial force F1 opposing axial movement of a rotor shaft 14 (see FIG. 4) of the pump 12 relative to a pump housing 16, in particular opposing an axial thrust force F2 generated by rotation of the pump rotor shaft 14 during operation. The device 10 is located at the non-drive end of the pump 12 adjacent to the pumps main radial bearing.

The device 10 has a first housing part 18 and a second housing part 20 which is axially moveable relative to the first housing part 18. The first housing part 18 is coupled to the pump housing 16. The second housing part 20 is coupled to the pump rotor shaft 14. A biasing member in the form of coil spring 21 is provided between the first housing part 18 and the second housing part 20 and, in use, the second housing part 20 is biased away from the first housing part 18 by the coil spring 21, this producing the opposing force F1 opposing axial movement of a rotor shaft 14. An offset or spacing 22 between the first housing part 18 and the second housing part 20 is configured to indicate the position of the pump rotor shaft 14 relative to the pump housing 16.

Where the pump 12 is fitted with a balance disk assembly (not shown) having a balance disk on the pump rotor shaft 14 and a counter disk on the pump housing 16, the device 10 acts to separate the balance disk and counter disk to prevent or at least mitigate damaging contact and/or wear between the balance disk and the counter disk. In particular, the device 10 is configured so that the spacing 22 between the first housing part 18 and the second housing part 20 provides an indication of the spacing between the balance disk and the counter disk, whereby it can be quickly and readily determined whether the balance disk assembly is working or configured correctly.

The first housing part 18 is coupled to the pump housing 16 by cap screws 24 which are secured through bores 26 in the first housing part 18 and into corresponding bores 28 provided in the pump housing 16. In the embodiment shown, six cap screws 24 and bores 28 are provided at circumferentially spaced locations around the first housing part 18.

Corresponding bores 30 are also provided in the second housing part 20 so that the cap screws 24 can be inserted and removed without the requirement to disassemble the device 10. Thus, the device 10 can be attached to and detached from the pump housing 16 as a single, cartridge which can be quickly and easily coupled and decoupled from the pump 12 for example for repair or replacement as required.

The first housing part 18 has a spigot 32 or neck which locates within a socket 34 in the pump housing 16. A circumferential seal 36 is also provided in a recess 38 in the pump housing 16 and seals between the pump housing 16 and the spigot 32 of the first housing part 18.

A shim 40 is provided around the spigot 32 and, on assembly, the first housing part 18 is axially offset or relieved from the pump housing 16.

The second housing part 20 is coupled to the first housing part 18 by a second spigot connection, the second housing part 20 forming a male spigot 42 for location with a female socket 44 provided in the first housing part 18. The second housing part 20 is secured to the first housing part 18 by a number of circumferentially spaced bolts 46 which are secured through bores 48 in the second housing part 20 and into corresponding bores 50 in the first housing part 18. In the embodiment shown, six bolts 46 and bores 48, 50 are provided.

The device 10 further comprises a stub shaft 52 which is mounted within the second housing part 20 and which, in use, is coupled to the pump rotor shaft 14. The end of the stub shaft 52 extends out of the device 10 and is coupled to the pump rotor shaft 14 by a further spigot connection 54, 56. The stub shaft 52 is secured to the pump rotor shaft 14 by a cap screw 58 which extends through a bore 60 in the stub shaft 52 and into a corresponding bore 62 in the pump rotor shaft 14. Accordingly, the shafts 14, 52 are secured so that axial movement of the pump rotor shaft 14 also translates the stub shaft 52. Relative rotation between the stub shaft 52 and the second housing part 20 is achieved via a ball bearing 64 and an angular contact bearing 66. The angular contact bearing 66 supports the stub shaft 52 and also permits the opposing force F1 to be transmitted to the pump rotor shaft 14 via the stub shaft 52.

In the embodiment shown, the ball bearing 64 is positioned adjacent to a radially extending flange portion 68 of the stub shaft 52 and the angular contact bearing 66 is provided adjacent to the distal end 70 of the stub shaft 52 (the end furthest away from the rotor shaft). A spacer 72 is provided around the stub shaft 52 between the bearings 64, 66 and a nut 74 and a washer 76 are provided at the distal end 70 of the stub shaft 52 to secure the angular contact bearing 66, bearing spacer 72 and the ball bearing 64 in place.

In order to provide lubrication to the bearings 64, 66, a lubricant feed passage in the form of slot 78 is provided through the second housing part 20 and a nipple 80 is insertable into the slot 78 to permit and restrict access to the bearings. In the embodiment shown, the bearings 64, 66 are grease lubricated for simplicity and cost efficiency, although other suitable lubricants may be employed if required.

A third housing part 80 is also provided and is coupled to the second housing part 20 by a number of circumferentially spaced cap screws 82 secured through bores 84 in the third housing part 80 and extending into bores 86 provided in the second housing part 20. In the embodiment shown, eight cap screws 82 and bores 84, 86 are provided. A central bore 88 is provided in the third housing part 80 in order to permit access to the stub shaft/rotor shaft securement cap screw 58. A plug 90 is also provided and when access to the cap screw 58 is not required, the plug 90 is secured in the bore 88.

Figure 6:
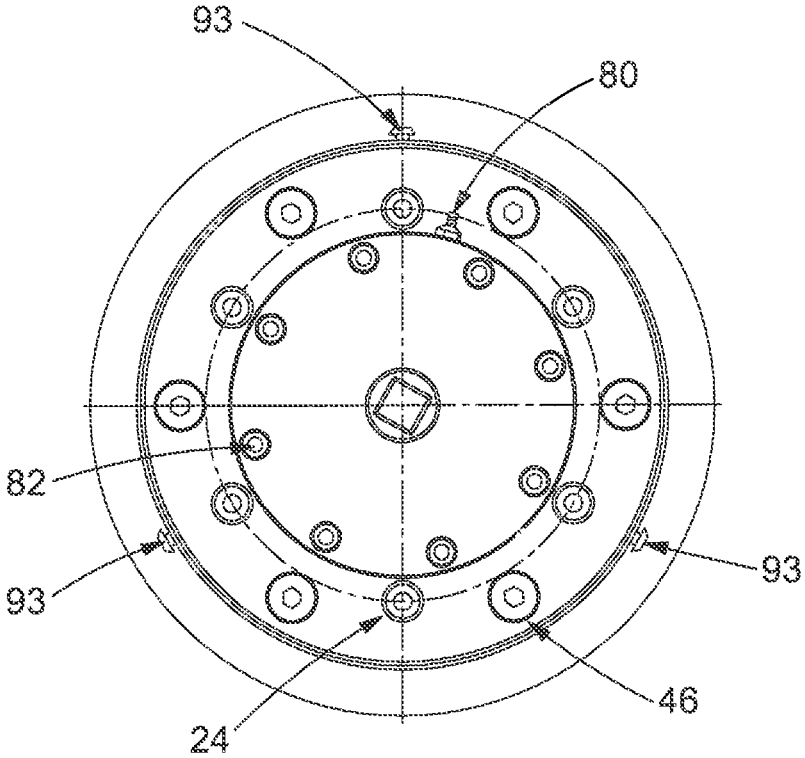
FIG. 6 is an end elevation view of the pump device of FIGS. 1 to 5.

A guard 92 is secured to the first housing part 18 by a fastener 93 (three fasteners are shown in FIG. 6 but one or more fastener may be provided as required) and forms an enclosure around the device 10. This prevents interference with, or injury from, the moving parts of the device 10.

Figure 7:
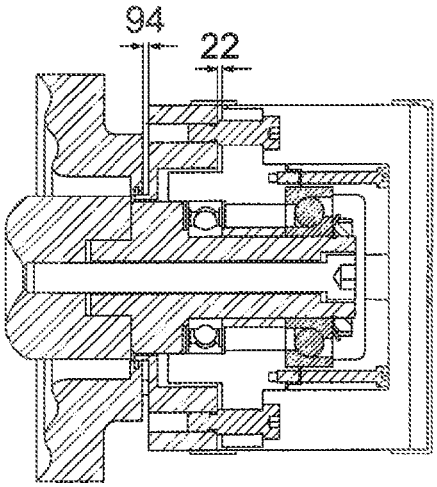
FIG. 7 is a longitudinal sectional view of the pump device prior to set-up.
Figure 8:
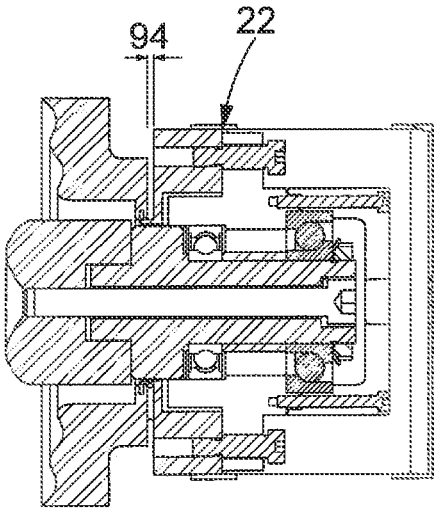
FIG. 8 is a longitudinal sectional view during set-up.
Figure 9:
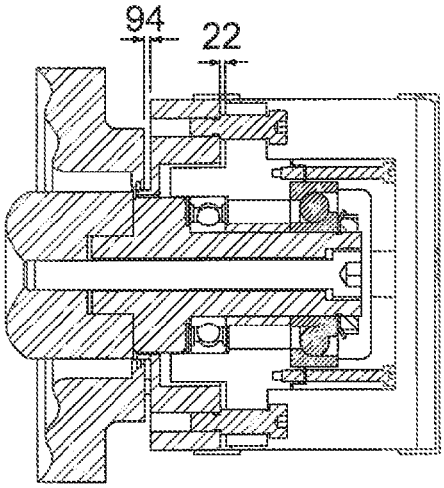
FIG. 9 is a longitudinal sectional view after set up.

An indicative set up procedure will now be described with reference in particular to FIGS. 7, 8 and 9 of the drawings.

Firstly, prior to setting the device 10, the pump rotor shaft 14 is positioned in its fully forward position such that the balance disk assembly is closed. The device 10 is then positioned on the pump rotor shaft 14 using the spigot 32 and socket 34 and the cap screw 58 is initially tightened to secure the stub shaft 52 and the pump rotor shaft 14 together. The operator should then measure the offset or relief spacing 94 between the first housing part 18 and the pump housing 16. The shim 40 is then selected so that this is 1 mm longer than the measured offset and the shim 40 is then inserted between the device 10 and the pump housing 16. The cap screw 58 may be loosened and tightened as necessary to permit insertion of the shim 40. The cap screws 24 are then inserted and tightened to the recommended torque to secure the first housing part 18 to the pump housing 16. The shaft cap screw 58 is then tightened to its recommended torque.

As described above, it is envisioned that the device 10 will be pre-assembled as a cartridge before assembly with the pump 12. Nevertheless, the operator should check that after the bolts 46 securing the first and second housing parts 18, 20 have been tightened, that the spacing between the first housing part 18 and the second housing part 20 is 1 mm. This means that the gap at the balance disk is also 1 mm.

If, on inspection during the operational life of the pump 12, the spacing 22 between the first housing part 18 and the second housing part 20 has closed, then it will be recognised that the gap at the balance disk has also closed, indicating that the balance disk has worn to the extent that this should be replaced. Thus, the position of the pump shaft 12 relative to the pump housing 16, and the position of the balance disk relative to the counter disk, can be readily determined externally without the requirement to shut down and disassemble the pump 12.

It should be understood that the embodiments described are merely exemplary of the present invention and that various modifications may be made without departing from the scope of the invention.

For example, although the embodiment described above describes that the inspection of the spacing 22 is performed manually, it will be recognised that the measurement of the spacing 22 may be performed automatically by a sensor and/or monitoring system configured to provide an automatic warning to the operator that the spacing 22 has reduced.

Although the embodiment described above describes a stub shaft for coupling to the pump rotor shaft 14, in alternative embodiments the device shaft may be formed as part of the pump rotor shaft.

The invention claimed is:

1. A pump device for applying a force opposing axial movement of a pump rotor shaft relative to a pump housing, the device comprising:

a first housing part adapted to be coupled to a pump housing and a second housing part axially moveable relative to the first housing part, the second housing part adapted to be coupled to the pump rotor shaft; and a biasing member coupled between the first housing part and the second housing part and configured to apply a force opposing axial movement of the pump rotor shaft in the pump housing, wherein the spacing between the first housing part and the second housing part is configured to indicate the axial position of the pump rotor shaft within the pump housing.

2. The pump device of claim 1, wherein the pump device comprises a pre-assembled cartridge adapted to be mounted to the pump.

3. The pump device of claim 1, further comprising a shaft rotatably coupled to the second housing part.

4. The pump device of claim 3, wherein the shaft is adapted to be coupled to the pump rotor shaft.

5. The pump device of claim 3, wherein the shaft is rotatably coupled to the second housing part by a bearing.

6. The pump device of claim 5, wherein the bearing comprises at least one of a ball bearing, an angular contact bearing and a journal bearing.

7. The pump device of claim 1, wherein the biasing member comprises a spring.

8. The pump device of claim 1, further comprising a third housing part coupled to the second housing part.

9. The pump device of claim 1, further comprising a guard.

10. A pump system comprising:

a pump; and a pump device for applying a force opposing axial movement of a pump rotor shaft relative to a pump housing, the pump device comprising a first housing part adapted to be coupled to a pump housing and a second housing part axially moveable relative to the first housing part, the second housing part adapted to be coupled to the pump rotor shaft; and a biasing member coupled between the first housing part and the second housing part and configured to apply a force opposing axial movement of the pump rotor shaft in the pump housing, wherein the spacing between the first housing part and the second housing part is configured to indicate the axial position of the pump rotor shaft within the pump housing.

11. A pump device comprising:

a first housing part adapted to be coupled to a pump housing and a second housing part axially moveable relative to the first housing part, the second housing part adapted to be coupled to the pump rotor shaft, wherein the spacing between the first housing part and the second housing part is configured to indicate the axial position of the pump rotor shaft within the pump housing.

* * * * *